US010485362B2

(12) United States Patent
Pintur

(10) Patent No.: US 10,485,362 B2
(45) Date of Patent: Nov. 26, 2019

(54) APPARATUS FOR PRESENTING ITEMS, PARTICULARLY EYEGLASSES

(71) Applicant: Mladen Pintur, Zagreb (HR)

(72) Inventor: Mladen Pintur, Zagreb (HR)

( * ) Notice: Subject to any disclaimer, the term of this patent is extended or adjusted under 35 U.S.C. 154(b) by 0 days.

(21) Appl. No.: 16/124,755

(22) Filed: Sep. 7, 2018

(65) Prior Publication Data

US 2019/0075944 A1 Mar. 14, 2019

(30) Foreign Application Priority Data

Sep. 8, 2017 (EP) ..... 17190213

(51) Int. Cl.
*A47F 7/02* (2006.01)
*A47F 5/00* (2006.01)

(52) U.S. Cl.
CPC ..... *A47F 7/021* (2013.01); *A47F 5/0087* (2013.01)

(58) Field of Classification Search
CPC ..... A47F 7/021; A47F 7/0243; A47F 5/0087; A47B 96/021
USPC ..... 211/85.1
See application file for complete search history.

(56) References Cited

U.S. PATENT DOCUMENTS 763,461 A * 6/1904 Burton ..... E05B 69/006 211/8
4,805,781 A * 2/1989 Tegel ..... A47F 7/0243 211/1.51
6,182,840 B1 * 2/2001 Tegel ..... A47F 7/0243 211/85.1
6,364,124 B1 * 4/2002 Chen ..... A47F 7/0243 211/4
7,134,559 B2 * 11/2006 Zoueki ..... A47F 7/0243 211/85.1
7,270,241 B2 * 9/2007 Nobili ..... A47F 7/0243 211/85.1
8,307,999 B2 * 11/2012 Pintur ..... A47F 7/0243 211/8
8,328,028 B1 * 12/2012 Freilich ..... A47F 7/021 211/85.1
9,408,480 B2 * 8/2016 O'Toole ..... A47F 5/16
2009/0014604 A1 1/2009 Pintur
(Continued)

FOREIGN PATENT DOCUMENTS

DE 9201825 U1 * 4/1992 ..... A47F 7/0243
DE 102006034876 A1 * 1/2008 ..... A47F 7/0243
DE 102007036602 A1 * 2/2009 ..... A47F 7/0243
(Continued)

*Primary Examiner* — Stanton L Krycinski
(74) *Attorney, Agent, or Firm* — Arent Fox LLP

(57) ABSTRACT

An apparatus for presenting items such as eyeglasses. The apparatus comprises at least one support plate capable of receiving items side by side. Furthermore, the apparatus at least one locking device on the at least one support plate. Each locking device is configured to be movable between a locked position for mechanically locking an item at the locking device and an unlocked position for releasing the item from the locking device the at least one support plate further includes a movable member disposed between a first panel of the at least one support plate and a second panel of the at least one support plate, wherein the movable member is configured to mechanically interact with an actuation portion to move the locking devices between a first locked position and a second unlocked position.

15 Claims, 7 Drawing Sheets

(56) References Cited

U.S. PATENT DOCUMENTS

| | | | | |
|---|---|---|---|---|
| 2015/0096997 | A1 | 4/2015 | Obitts et al. | |
| 2016/0235221 | A1 * | 8/2016 | Tegel | A47F 7/0243 |

FOREIGN PATENT DOCUMENTS

| | | | | | |
|---|---|---|---|---|---|
| DE | 102008054023 | A1 * | 5/2010 | ..... | A47F 7/0243 |
| DE | 10 2010 022 422 | A1 | 12/2011 | | |
| EP | 0220006 | A2 * | 4/1987 | ..... | A47F 7/0243 |
| EP | 1 768 524 | B1 | 2/2008 | | |
| EP | 2392235 | A1 * | 12/2011 | ..... | A47F 7/0243 |
| FR | 2570263 | A1 * | 3/1986 | ..... | A47F 7/0243 |
| FR | 2572637 | A1 * | 5/1986 | ..... | A47F 7/024 |
| GB | 2024003 | A * | 1/1980 | ..... | A47F 7/0243 |
| WO | WO 2010/090511 | A1 | 8/2010 | | |
| WO | WO 2012/050435 | A2 | 4/2012 | | |

* cited by examiner

APPARATUS FOR PRESENTING ITEMS, PARTICULARLY EYEGLASSES

CROSS-REFERENCE TO RELATED APPLICATION

This application claims the benefit of priority to European Patent Application No. 17 190 213.3, filed Sep. 8, 2017. The disclosure of the priority application is hereby incorporated in its entirety by reference.

The invention refers to an apparatus for presenting items, particularly eyeglasses.

Different kinds of equipment for presenting items to a user are known from the prior art. One kind of equipment uses one or more support plates extending in a horizontal direction for placing items thereon. Those support plates can be provided with locking devices for mechanically locking the items on the plate in order to avoid theft. Up to now, the locking devices in this kind of equipment cannot be actuated simultaneously.

Furthermore, another kind of equipment presenting items vertically one upon another is known from the prior art. In this kind of equipment, the items to be presented are arranged in vertical rows without placing them on a horizontal plate. For this equipment, locking mechanisms exist which enable a simultaneous locking and unlocking of the items presented in a vertical row. Such a locking mechanism for an apparatus presenting spectacles is disclosed in document EP 1 768 524 B1.

It is an object of the invention to provide an apparatus for presenting items in a horizontal direction on a one or more support plates providing an easy mechanism for locking and unlocking the presented items on the respective support plate.

This object is solved by the apparatus according to claim 1. Preferred embodiments of the invention are described in the dependent claims.

The apparatus of the invention serves for presenting items, particularly eyeglasses. The apparatus comprises one or more support plates, each support plate being configured for placing items side by side in a horizontal direction thereon when the apparatus in use. Preferably, the support plate is a flat plate extending in a horizontal plane when the apparatus in use. However, the support plate can have another shape as long as items can be placed thereon side by side in the horizontal direction. In a preferred embodiment, each support plate is a longitudinal plate where the longitudinal extension of the plate corresponds to the direction in which the items can be placed side by side on the plate.

The apparatus of the invention comprises a number of locking devices and particularly a plurality of locking devices arranged on a respective support plate (i.e. each support plate), each locking device being configured to be movable between a locked position for mechanically locking an item at the locking device and an unlocked position for releasing the item from the locking device.

In the apparatus of the invention, a respective support plate (i.e. each support plate) comprises a movable member disposed between a first panel of the support plate being an upper panel when the apparatus is used and a second panel of the support plate being a lower panel when the apparatus is in use. The movable member is configured to mechanically interact with an actuation means and with the number of locking devices such that the movable member can be moved by the actuation means between a first position in which each locking device of the number of locking devices on the respective support plate is in the locked position and a second position in which each locking device of the number of locking devices is in the unlocked position. In a preferred embodiment, the movable member is a movable panel. Nevertheless, the movable member may be another element as well.

The apparatus according to the invention has the advantage that an easy locking and unlocking mechanism can be achieved by a movable member. Due to the use of this movable member, the number of locking devices can be actuated with just one activity. I.e., only one operation needs to be performed for closing the number of locking devices and only one operation needs to be performed for opening the number of locking devices. Furthermore, the apparatus can be easily installed on existing shelves for presenting articles by placing the support plate on the shelf. In a preferred embodiment, several locking devices can be actuated simultaneously or one by one by the actuation means in case that the apparatus comprises more than one locking device on the respective support plate.

In a preferred embodiment of the apparatus according to the invention, a middle panel in at least one support plate and particularly each support plate is disposed between the first panel and the second panel, the middle panel having a shape such that a space is formed between the first panel and the second panel, the movable member being positioned in this space. The middle panel enables an arrangement of the movable member such that the movable member cannot be seen from outside.

In a preferred variant of the above embodiment, the middle panel extends at a front edge of the support plate facing toward the side from which items placed on the support plate are viewed so that the movable member is not visible from this side. I.e., users looking at the presented items do not see the movable member resulting in an attractive design of the apparatus for presenting items. In another preferred embodiment, the space in which the movable member is positioned encloses the movable member so that the movable member cannot be seen from any viewing direction onto the presented items.

In another preferred embodiment, the first panel and the second panel in at least one support plate and particularly each support plate are spaced apart from each other by a distance greater than the thickness of the movable member, thus enabling a movement of the movable member with low resistance. To achieve the above distance, one or more spacers may be used which are located between the first panel and the second panel. However, this distance may also be achieved by the above middle panel having a thickness corresponding to this distance.

In another preferred embodiment of the invention, each locking device of the number of locking devices on at least one support plate and particularly each support plate comprises a movable element which is movable, preferably horizontally, within a housing of the locking device in order to effect a movement of a locking element in the locking device, where the movable element is connected with the movable member so that the movement of the movable member results in a movement of the movable element. This embodiment provides compact locking devices where the mechanical structure is covered by a housing.

In a preferred variant of the above embodiment, the movable element is a sliding element for performing a sliding movement within the housing. In another preferred variant of the above embodiment, the locking element is a hook being rotatable between the locked position and the unlocked position of the locking device, where in the locked position an enclosing portion surrounding a hole is formed in the locking device by the aid of the hook for accommodating an item in the hole, the enclosing portion being opened when the hook is rotated from the locked to the unlocked position.

In another embodiment of the invention, the movable element is coupled to the locking element via a gear mechanism, i.e. a mechanism comprising cogs engaging with each other. In a preferred variant, the gear mechanism comprises at least one cog wheel engaging with a first, preferably horizontal portion of cogs on the movable element and a second, preferably curved portion of cogs on the locking element.

In another embodiment of the apparatus according to the invention, at least one locking device of the number of locking devices on at least one support plate and particularly each support plate comprises at least one reduction element reducing the size of a hole by which an item is fixed in the locked position. This enables the adaption of the locking device to different sizes of items to be locked. The hole may correspond to the above described hole surrounded by an enclosing portion.

The actuation means in the apparatus according to the invention may be a manual actuation means, i.e. an actuation means operated by a user. This actuation means is configured to effect a manual movement of the movable member in at least one support plate and particularly each support plate.

In another embodiment of the invention, the actuation means comprises in at least one support plate an actuation device which is preferably operated manually. In one variant of this embodiment, the actuation device is provided in each support plate. The actuation device is located between the first panel and the second panel and comprises one or more pins, each pin being located in a corresponding recess in the movable member when each locking device is in the locked position. The actuation means further comprises a slot in the movable member for inserting an actuation bar into the slot. Preferably, the one or more pins are arranged adjacent to this slot. The insertion of the actuation bar into the slot effects a retraction of each pin from the corresponding recess, whereupon (i.e. after retraction of each pin) the actuation bar is able to push the movable member so that the movable member moves from the first position corresponding to the locked position to the second position corresponding to the unlocked position. Preferably, the slot is accessible via an opening between the first panel and the second panel where the opening is preferably placed on the above defined front edge of the support plate. This embodiment of the invention provides an easy mechanical solution for locking the locking devices.

In a preferred variant of the above embodiment, the actuation device comprises a number of first magnets exerting a magnetic force which presses each pin in the corresponding recess when each locking device is in a locked position, where the actuation device is configured to interact within an embodiment of the actuation bar comprising a number of second permanent magnets exerting a magnetic force on each pin which retracts each pin from a corresponding recess when the actuation bar is inserted into the slot. Preferably, one or more first permanent magnets correspond to the above defined pins or are part of the above pins.

In another embodiment of the apparatus according to the invention, the actuation device comprises at least one third permanent magnet which is configured to interact with at least one fourth permanent magnet in the actuation bar so that the at least one third permanent magnet and the at least one fourth permanent magnet effect a coupling between the movable member and the actuation bar by an attractive force between the at least one third permanent magnet and the at least one fourth permanent magnet when the actuation bar inserted into the slot reaches a stop position within the slot, where the coupling enables a movement of the movable member from the second position to the first position by pulling the actuation bar out of the slot. This solution is preferably combined with the above embodiment comprising a number of first permanent magnets and a number of second permanent magnets. However, the at least one third permanent magnet and the at least one fourth permanent magnet may also be included in the actuation device without providing the above number of first and second permanent magnets.

In another variant of the invention, the actuation means is configured to effect an automatic movement of the movable member in at least one support plate and particularly each support plate by at least one electromechanical actuator, e.g. at least one motor. The actuation means may be configured to provide both an automatic actuation and a manual actuation for locking and unlocking the locking devices.

In another embodiment of the invention, the apparatus comprises several support plates, preferably arranged one above the other when the apparatus is in use, where the actuation means comprises a mechanical connection between the support plates such that the actuation means effects a movement of the movable member in all support plates between the first position and the second position. This variant enables a simultaneous locking and unlocking of locking devices on different support plates. Preferably, the support plates are attached to a frame. Preferably, the mechanical connection is located behind this frame so that this mechanism can be hidden by the frame.

In a preferred variant of the above embodiment, the mechanical connection comprises a connecting bar, preferably a vertical connecting bar, having connecting rods, preferably vertical connecting rods, for each support plate, each connecting rod being mechanically connected to the movable member of a respective support plate in order to effect the movement of the movable member in the respective support plate. Preferably, the connecting rod is connected to protrusions of the movable member extending out of the support plate and preferably out of a rear edge of the support plate being opposite to the front edge which faces toward the side from which items placed on the support plate are viewed.

In the following, embodiments of the invention will be described in detail with respect to the accompanying drawings wherein.

In the following, an embodiment of the invention will be described with respect to FIGS. 1 to 6 where the apparatus for presenting items comprises a single horizontal support plate. This embodiment is used for presenting eyeglasses on the horizontal support plate. Nevertheless, the embodiment may also be used for presenting other items.

Figure 1:
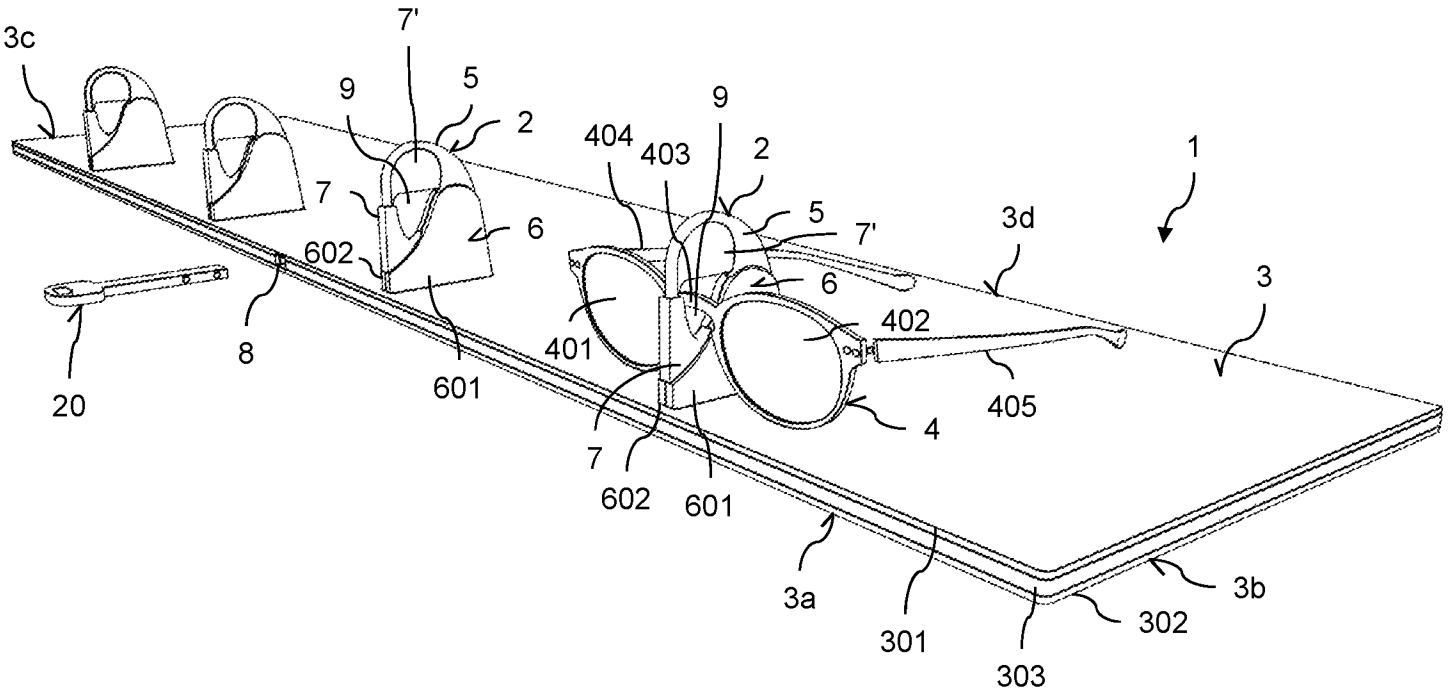
FIG. 1 is a perspective view of an apparatus according to an embodiment of the invention in the locked position of the locking devices.

FIG. 1 shows a perspective view of the apparatus 1 for presenting eyeglasses. The apparatus comprises a support plate 3 extending in a horizontal direction when the apparatus 1 is in use. The support plate serves to dispose eyeglasses thereon for presenting these eyeglasses to users, e.g. customers in an optician's shop. In order to avoid theft of the eyeglasses, several locking devices 2 are provided on the support plate 3. The embodiment of FIG. 1 comprises four such locking devices where only one pair of eyeglasses 4 is locked by the locking device 2 at the right end of the support plate 3. For the sake of clarity, reference numerals are only used for two of the locking devices shown in FIG. 1.

The support plate 3 comprises an upper panel 301 and a lower panel 302 where a middle panel 303 is interposed between the upper and the lower panels. Panels 301 to 303 are preferably made of plastic, e.g. acryl. The panels have a longitudinal rectangular shape so that the support plate 3 comprises a long front edge 3*a* and an opposite long rear edge 3*d* as well as a short right edge 3*b* and a short left edge 3*c*. The front edge 3*c* is located adjacent to users looking at the eyeglasses presented by the apparatus 1.

The middle panel 303 has a shape such that a space is formed between the upper panel 301 and the lower panel 302. In this space, a movable panel is disposed between the panels 301 and 302. The movable panel is an embodiment of the movable member as defined in the patent claims. This movable panel cannot be seen in FIG. 1 and will be described in detail further on. The front edge 3*a* of the support plate 3 comprises at a central location between the edges 3*b* and 3*c* an opening 8 which is formed in the middle panel 303. This opening provides access to a slot 27 (see FIG. 5) for inserting an actuation bar in the form of a key 20 into the slot. The slot cannot be seen in FIG. 1 and will be described in more detail further on.

Each locking device 2 comprises a plastic housing 6 fixed to the support plate 3, where the housing is made of a first housing part 601 and a second housing part 602 which are connected to each other by gluing. A replaceable element 7 made of plastic is arranged on an upper portion of the housing 6. Furthermore, the housing rotatably holds a curved hook 5 which can be pivoted around a horizontal axis. The hook is preferably made of a metal alloy, e.g. Zamak. In FIG. 1, the hooks 5 of all locking devices 2 are in a locked position where the front end of each hook is positioned within an opening of the replaceable element 7 and abuts on an upper part of the housing 6. In this locked position, an enclosing portion is formed in the respective locking device, the enclosing portion surrounding a hole 9. Within this enclosing portion, the pair of eyeglasses 4 shown in FIG. 1 is locked by the locking device 2 at the support plate 3.

The pair of eyeglasses 4 comprises glasses 401 and 402 as well as a frame comprising frame portions around the glasses, a nose bridge 403 and two temples 404 and 405. In the position shown in FIG. 1, the bottom of each frame portion around the glasses 401 and 402 contacts the upper panel 301. Furthermore, the upper panel 301 is contacted by the rear ends of the temples 404 and 405. The pair of eyeglasses 4 is positioned on the support plate 3 such that the nose bridge 403 goes through the hole 9. The vertical extension of the glasses 401 and 402 is greater than the vertical extension of the hole 9 so that the pair of eyeglasses 4 cannot be removed from the locking device 2.

The replaceable element 7 can be regarded as a reduction element in the sense of the claims. Furthermore, the locking device 2 comprises another reduction element 7' in the form of an acrylic and preferably transparent plate 7' disposed into a slot 21 (see FIG. 3) at an inner edge of the hook 5. Analogously to the element 7, the reduction element 7' can be changed. By inserting reduction elements 7 and 7' with variable sizes at the housing 6 and the hook 5, the size of the hole 9 can be adapted. E.g., the size of the hole can be reduced in case that a pair of eyeglasses with glasses having a very low height shall be locked at the support plate 3. By doing so, such a pair of eyeglasses cannot be stolen by vertically moving its glasses out of the hole 9.

As already mentioned above, all locking devices 2 are in the locked position in the scenario of FIG. 1. In this position, the actuation bar 20 is not inserted into the opening 8. For unlocking the locking devices, the actuation bar 20 is inserted manually by a user into the slot at the opening 8. As a consequence, permanent magnets in the actuation bar interact with corresponding permanent magnets disposed adjacent to the slot so that a magnetic latching is released when the actuation bar reaches a stop position within the slot. This will be described in more detail with respect to FIGS. 5 and 6. After releasing the magnetic latching, the actuation bar 20 can be pushed further on into the opening 8 resulting in a pushing of the movable panel effecting a simultaneous upward rotation the of the hooks 5 in all locking devices 2, thus resulting in an opening of the enclosing portion as can be seen from FIG. 2. In this unlocked position of the locking devices, the pair of eyeglasses 4 can be removed. When retracting the actuation bar 20 out of the opening 8, an inverse rotation of the hooks 5 is effected so that the hooks are returned to the locked position shown in FIG. 1.

Figure 2:
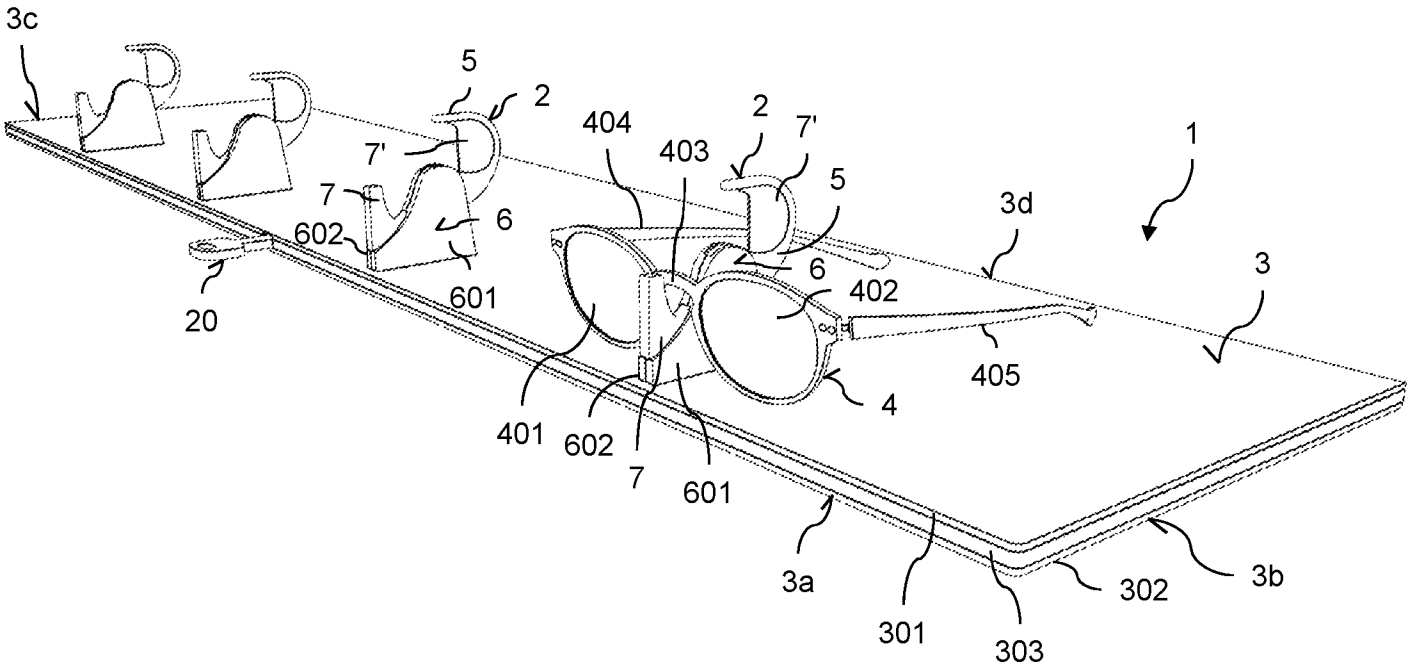
FIG. 2 is a perspective view of the apparatus of FIG. 1 with the locking devices in the unlocked position.
Figure 3:
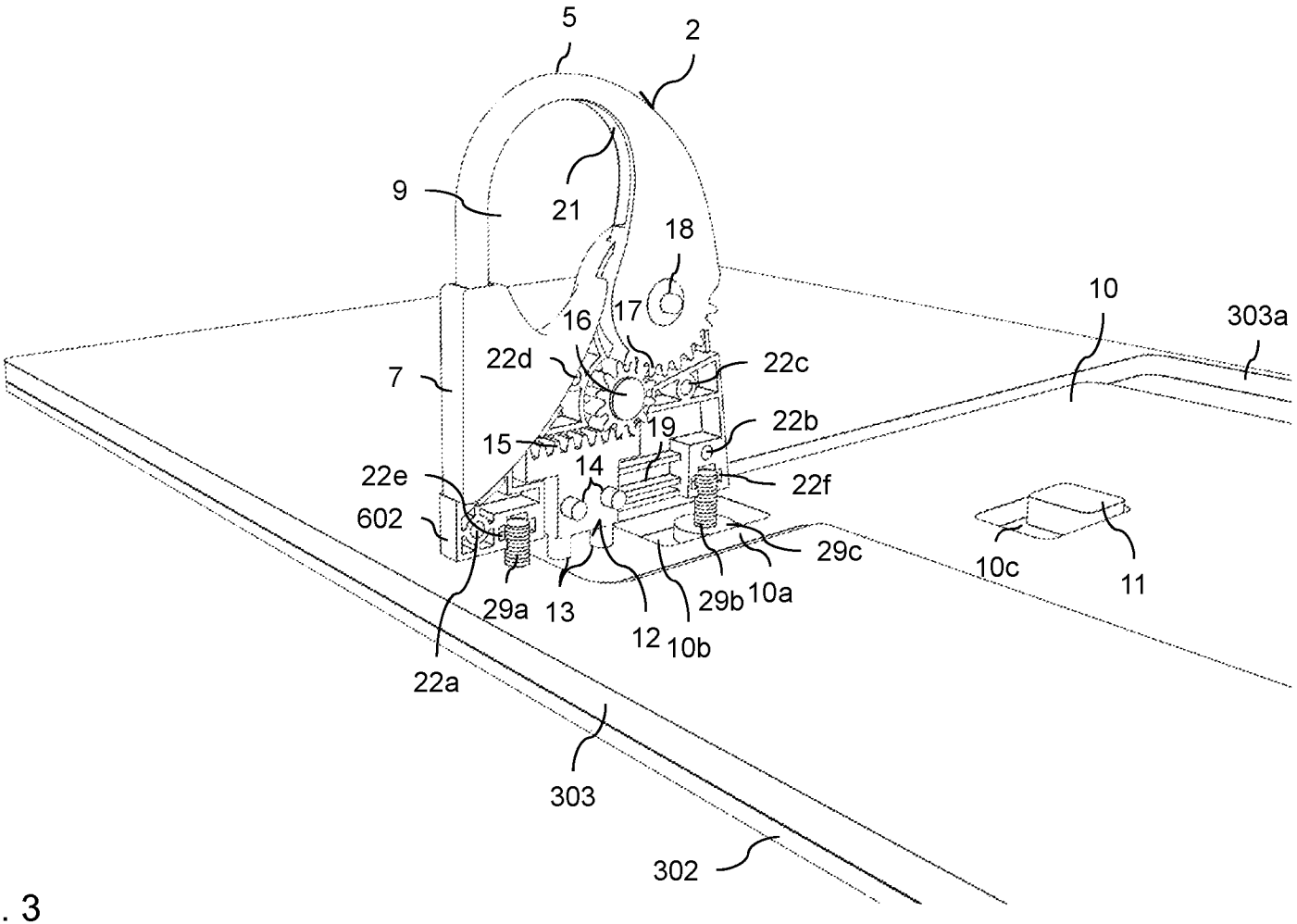
FIG. 3 is a detailed perspective view of one locking device of the embodiment shown in FIGS. 1 and 2 where the interior of the locking device is exposed and where the locking device is in the locked position.

FIG. 3 shows a detailed perspective view of one of the locking devices 2 of the apparatus shown in FIGS. 1 and 2. In this perspective view, the right housing part 601 of the housing 6 is omitted in order to expose the interior of the locking device 2. Furthermore, the reduction element 7' is omitted in order to expose the slot 21 for inserting the reduction element. Moreover, a replaceable element 7 of another size than in FIGS. 1 and 2 is attached to the housing 6 of the locking device 2. Furthermore, the upper panel 301 is omitted in order to expose the movable panel between the panels 301 and 302. This movable panel is designated with reference numeral 10. The movable panel 10 is located in a cut-out portion 303*a* of the middle panel 303 and it is preferably made of metal (e.g. aluminum). The cut-out portion 303*a* has a bigger size than the movable panel 10 so that a movement of the movable panel between the front and rear edges of the support plate 3 can be achieved.

The movable panel 10 comprises protrusions 10*a*, where each protrusion interacts with one locking device 2 on the support plate 3. Only one protrusion 10*a* is shown in FIG. 3. This protrusion 10*a* protrudes from the rest of the movable panel 10 in a direction toward the front edge of the support plate 3. The movable panel 10 has a rectangular opening 10*b* within the area of the protrusion 10*a*. Furthermore, another rectangular opening 10*c* is provided in a middle portion of the movable panel 10. The upper side of the middle panel 303 is in contact with the lower side of the upper panel 301. The thickness of the middle panel 303 is greater than the thickness of the movable panel 10 in order to enable a sliding movement of the panel 10 with low resistance between the panels 301 and 302. For assisting the sliding movement, a spacer 11 is inserted in the opening 10*c* of the movable panel 10 where the spacer has the thickness of the middle panel 303. This spacer avoids a contact between the lower side of the upper panel 301 and the upper side of the movable panel 10.

The left housing part 602 shown in FIG. 3 comprises several holes 22*a*, 22*b*, 22*c* and 22*d* where corresponding pins provided at the right housing part 601 are inserted into those holes when attaching the housing parts 601 and 602 to each other. For fixing those housing parts, glue is positioned within the respective holes 22*a* to 22*d*. The structure of the housing part 601 corresponds to the structure of the housing part 602 with the only difference that the housing part 601 has pins whereas the housing part 602 has holes. For fixing the housing 6 to the support plate 3, pockets 22*e* and 22*f* are located in the interior of the housing. Opposing pockets on both housing parts form two greater pockets. In each of those greater pockets, a metallic nut 29*d* is inserted before connecting the housing parts 601 and 602. The metallic nuts are not shown in FIG. 3. However, those nuts can be seen in FIG. 4.

For attaching the housing 6 to the support plate 3, screws 29*a* and 29*b* are inserted in corresponding holes of the support plate where the upper ends of the screws are screwed into the metallic nuts 29*d* within the pockets 22*e* and 22*f* Both screws 29*a* and 29*b* go through corresponding holes within the upper and lower panels 301 and 302. Furthermore, screw 29*b* is located within the opening 10*b* of the movable panel 10 whereas screw 29*a* goes through an opening within the middle panel 303. In order to keep the distance between the upper panel 301 and the lower panel 302, a plastic distance ring 29*c* having the thickness of the middle panel 303 is positioned on the screw 29*b*. The heads of the screws 29*a* and 29*b* are located at the lower side of the lower panel 302. By inserting a screwdriver in a slot of a respective head, the screw can be rotated in order to fix the housing 6 at the upper side of the upper panel 301.

The housing 6 accommodates a movable element in the form of a sliding element 12 which can be moved within a horizontal channel in the horizontal direction. The channel is built by corresponding U-shaped profiles 19 within the housing parts 601 and 602. A pair of horizontal pins 14 is formed on the right side of the sliding element 12. Analogously, a pair of horizontal pins 14' is formed on the left side of the sliding element 12. The pair of horizontal pins 14' cannot be seen from FIG. 3. However, one of those pins 14' is visible from FIG. 4. The pins 14 are guided by the profile 19 of the housing part 601 whereas the pins 14' are guided in the profile 19 of the housing part 602.

Furthermore, two vertical pins 13 are located at the lower side of the sliding element 12. Those pins are inserted into corresponding holes in the protrusion 10*a*. The pins 13 go through a longitudinal slot (not shown) in the upper panel 301. This slot extends in a direction perpendicular to the front and rear edges of the support plate 3. The slot has a length enabling a movement of the sliding element 12 so that the movable panel 10 can be placed in a first position corresponding to the locked position of the locking device 2 and a second position corresponding to the unlocked position of the locking device 2.

The upper side of the sliding element 12 comprises a portion 14 of horizontally arranged cogs. These cogs engage with cogs of a cog wheel 16 pivotably supported within the housing 6. The cogs of the cog wheel 16 also engage with a curved portion 17 of cogs formed in a lower part of the hook 5. The hook is pivotably supported within the housing by a horizontal shaft 18. The cog portions 15 and 17 as well as the cog wheel 16 provide a gear mechanism for converting the horizontal movement of the sliding element 12 into a rotation of the hook 5.

In the scenario shown in FIG. 3, the actuation bar 20 is not inserted in the hole 8 with the consequence that the movable panel 10 is in its foremost position which is the first position in the sense of the claims. In this position, the locking device 2 is locked by the hook 5. Pushing the actuation bar 20 into the hole 8 results in a movement of the movable panel 10 in a direction toward the rear edge of the support plate 3. As a consequence of this movement, the sliding element 12 will be moved rearwardly as can be seen from FIG. 4. This movement effects the rotation of the cog wheel 16 and the corresponding rotation of the hook 5 in a clock-wise direction, resulting in the opening of the enclosing portion, i.e. the unlocking of the locking device 2, as can be seen from FIG. 4.

Figure 4:
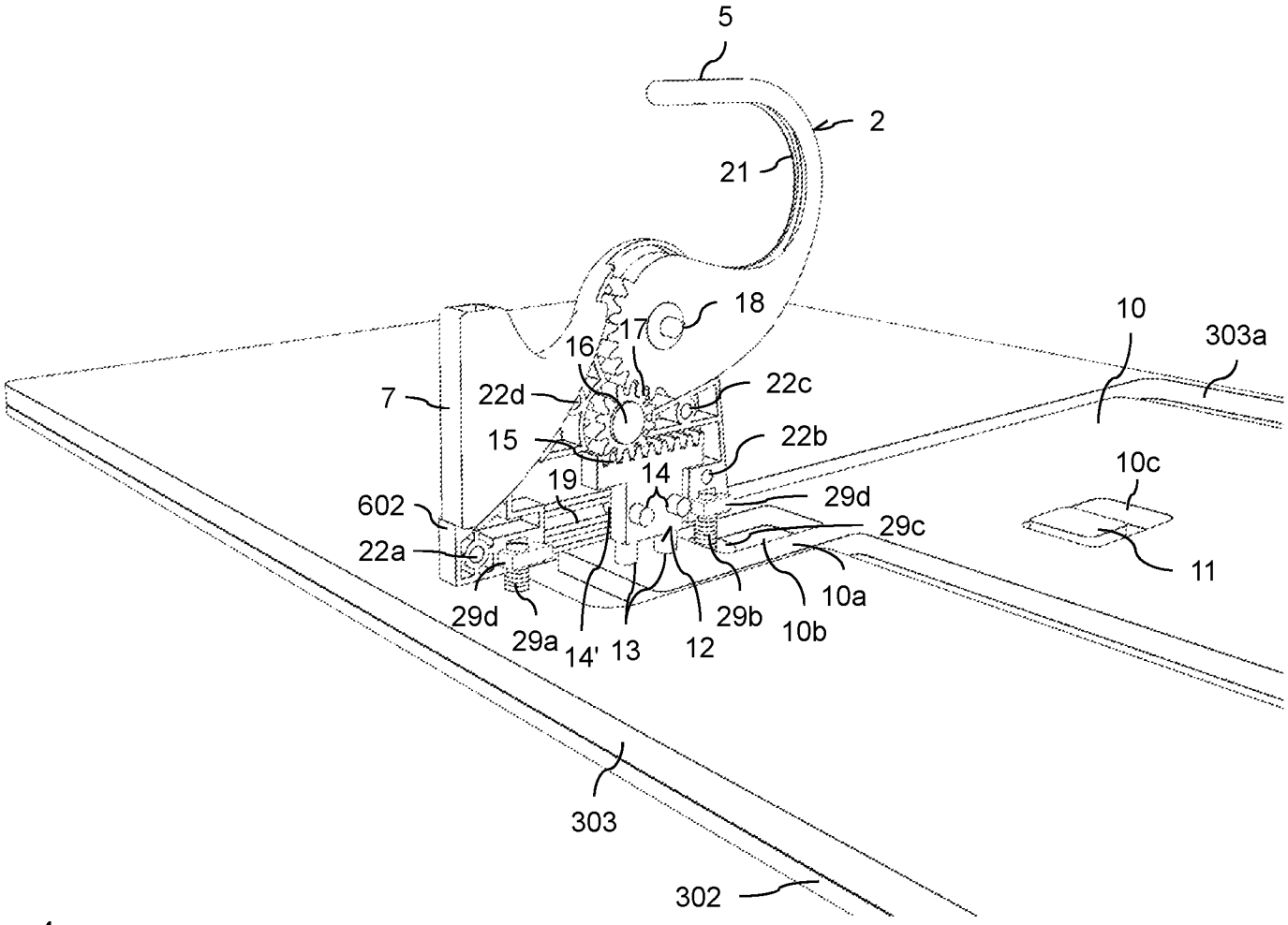
FIG. 4 is a detailed perspective view of the locking device of FIG. 3 where the locking device is in the unlocked position.

FIG. 4 shows a scenario where the movable panel 10 is located in its rearmost position corresponding to the second position in the sense of the claims. In this position, the locking device 2 is unlocked so that a pair of eyeglasses can be positioned on the element 7. In order to return to the locked position, the actuation bar 20 is pulled out of the opening 8, resulting in a movement of the movable panel toward the front edge of the plate. This movement is enabled by magnetic forces between permanent magnets as will be described with respect to FIGS. 5 and 6 further on. As mentioned above, a protrusion 10*a* for connecting the movable panel 10 with the locking device 2 is provided for each locking device on the support plate 3. Hence, the locking devices can be simultaneously unlocked and locked by a movement of the actuation bar 20 in the slot adjacent to the opening 8.

Figure 5:
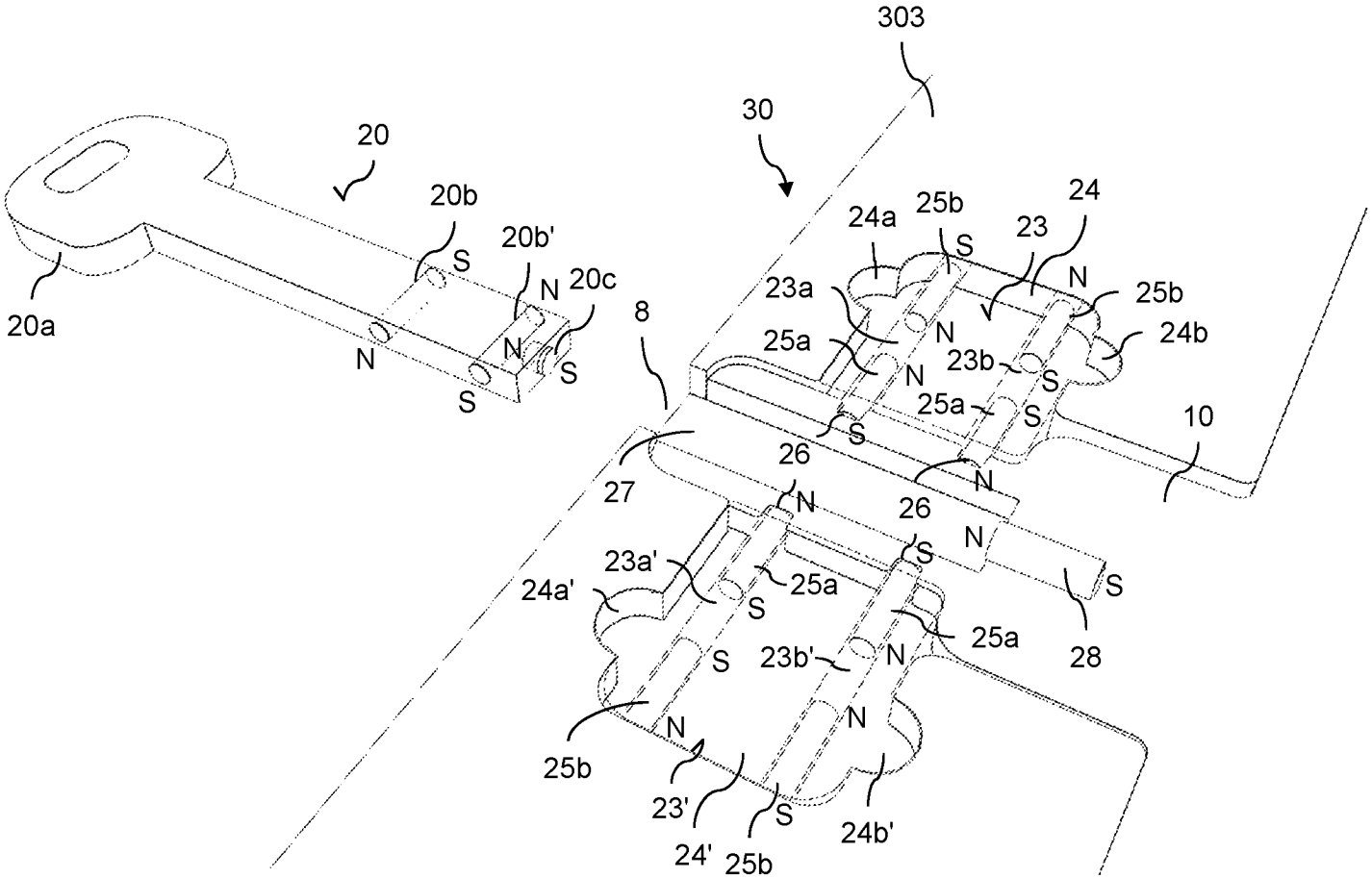
FIG. 5 is a detailed perspective view of the actuation device incorporated in the embodiment of FIGS. 1 to 4 in the locked position of the locking devices.

FIG. 5 shows a detailed perspective view of the actuation device 30 for moving the movable panel 10 by the aid of the actuation bar 20. The upper panel 301 is omitted in FIG. 5 in order to expose the actuation mechanism. The actuation device 30 comprises two plastic inserts 23 and 23' which are held in respective cut-out portions 24 and 24' located within the middle panel 303. The cut-out portion 24 comprises two opposing semi-circular depressions 24*a* and 24*b*. Analogously, the cut-out portion 24' comprises two opposing semi-circular depressions 24*a*' and 24*b*'. Those depressions are filled by corresponding elevations of the inserts 23 and 23', thereby preventing a tilting of the inserts within the middle panel 303.

Each of the inserts 23 and 23' comprises cylindrical, horizontally extending holes 23*a*, 23*b* and 23*a*', 23*b*', respectively. Within each of those cylindrical holes, a pair of permanent magnets 25*a*, 25*b* is inserted. The permanent magnets 25*a* are slidable within the respective holes. Contrary to that, the magnets 25*b* are fixed within the respective holes. The magnetic poles of the permanent magnets 25*a*, 25*b* and the magnetic poles of the permanent magnets 20*b*, 20*b*', 20*c* and 28 described further on are indicated by reference numerals N and S where N refers to the north pole and S refers to the south pole of the respective magnet. The inserts 23 and 23' with the corresponding magnets 25*a*, 25*b* are located at opposite sides of a channel formed within the middle panel 303. A tip of the movable panel 10 is located within this channel. This tip comprises the longitudinal slot 27 which is accessible via the opening 8 provided at the front edge of the middle panel 303.

In the scenario of FIG. 5, the locking devices are in the locked position. In this position, the magnets 25*a* of both inserts 23 and 23' are inserted into corresponding recesses 26 provided at the tip of the movable panel 10. The magnets 25*a* can be regarded as pins being located in corresponding recesses as defined in the claims. As can be seen from FIG. 5, the orientation of the permanent magnets 25*a*, 25*b* within each cylindrical hole is such that the magnets 25*a* and 25*b* exert a repellant magnetic force to each other. As a consequence, the magnets 25*a* are pressed into the corresponding recesses 26 so that the movable panel 4 is firmly held in the first position corresponding to the locked position of the locking devices 2.

At the bottom of the slot 27, another permanent magnet 28 is positioned within the movable panel 10. The function of this magnet will be described with respect to FIG. 6. Furthermore, as can be seen from FIG. 5, the actuation bar 20 comprises a gripping portion 20*a* for gripping the bar by a user at the left end. Moreover, a permanent magnet 20*b* as well as a permanent magnet 20*b'* are inserted in a lateral direction of the bar whereas another permanent magnet 20*c* is located at the front end of the bar.

Figure 6:
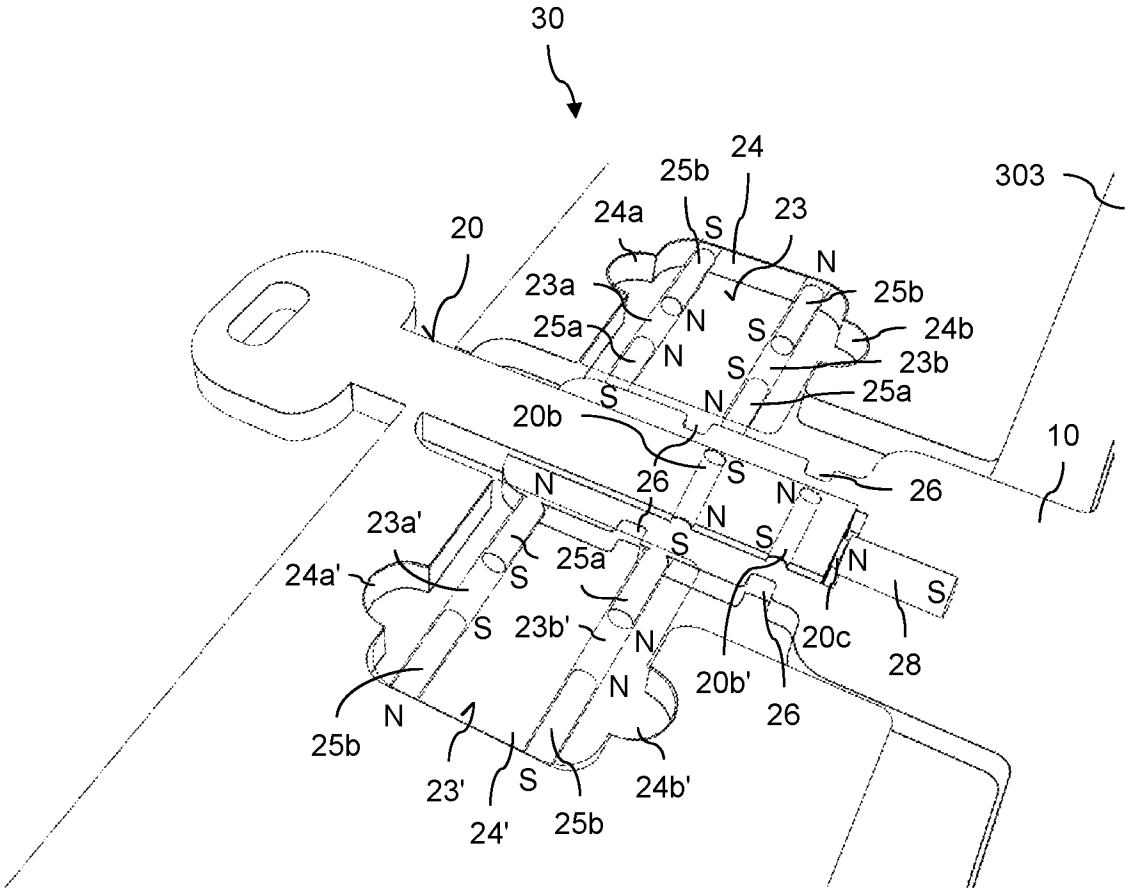
FIG. 6 is a detailed perspective view of the actuation device of FIG. 5 where the locking devices are in the unlocked position.

FIG. 6 shows the interaction of the actuation bar 20 with the actuation device 30 when pushing the bar into the slot 27. When the movement of the bar within the slot 27 reaches the position where the front end of the bar contacts the bottom of the slot 27, the magnet 20*b'* is aligned with the magnets 25*a*, 25*b* in the cylindrical holes 23*b*, 23*b'*. Analogously, the permanent magnet 20*b* is aligned in this position with corresponding magnets 25*a*, 25*b* located in the cylindrical holes 23*a*, 23*a'*. Due to the orientation of the magnets, a repellent force is generated between the magnets 25*a* and the respective opposing magnets 20*b*, 20*b'*. The strength of the magnets 20*b*, 20*b'* is such that the repellent force results in a retraction of the magnets 25*a* from the corresponding recesses 26, thus releasing the movable panel 10. As a consequence, when the actuation bar 20 is further pushed into the opening 8, the movable panel 10 will be pushed in a direction toward the rear edge of the support plate 3, resulting in an unlocking of the locking devices 2.

In the scenario of FIG. 6, the movable panel 10 is in the second position corresponding to the unlocked position of the locking devices 2. This position corresponds to the position shown in FIG. 4. As can be seen from FIG. 6, the magnet 20*c* in the actuation bar 20 is located adjacent to the magnet 28 in the movable panel 10 when the actuation bar is completely inserted into the slot 27. Due to the orientation of those magnets, an attractive force is exerted between them, resulting in a contact force between the actuation bar 20 and the movable panel 10. As a consequence, when the actuation bar 20 is pulled out of the opening 8 starting from the second position of the movable panel 10 shown in FIG. 6, the movement of the actuation bar 20 results in a corresponding movement of the movable panel 10 due to the contact force generated by the magnets 20*c* and 28. Hence, the movable panel is moved from the second position to the first position by pulling the actuation bar out of the opening 8, thus resulting in a locking of the locking devices 2.

Figure 7:
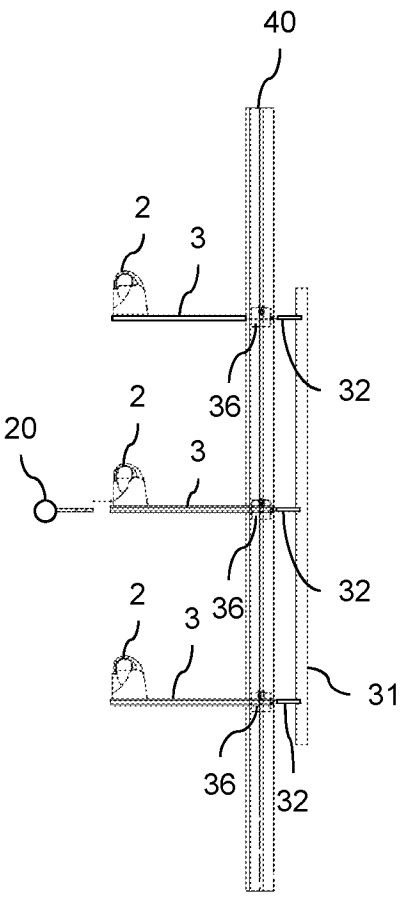
FIG. 7 is a side view of a modification of the embodiment of FIGS. 1 to 6 where locking devices on several support plates can be actuated simultaneously, the locking devices being in the locked position.

FIG. 7 shows a modification of the apparatus described with respect to FIGS. 1 to 6. In this modification, instead of using a single support plate for presenting eyeglasses, several vertically aligned support plates 3 are used. As can be seen from the side view in FIG. 7, three support plates are held by a frame 40 between vertical frame legs where only one frame leg can be seen in FIG. 7. Suitable attachment devices 36 for fixing each support plate 3 at the frame 40 are located at each frame leg. The structure of those attachment devices is not essential for the invention and, thus, will not be explained in detail.

The support plate 3 in the middle position of the apparatus in FIG. 7 substantially corresponds to the support plate as described with respect to FIGS. 1 to 6. However, an additional protruding pin 33 (see FIG. 8) is formed at the rear end of the movable panel 10 at its central part between the right and the left edges of the support plate. The protruding pin 33 can protrude from the rear edge of the support plate. To do so, a corresponding opening is provided in the middle panel 303 at its rear edge. The upper and lower support plates shown in FIG. 7 have the same structure at the support plate in the middle with the only difference that the actuation device 30 is omitted in those support plates.

The protruding pins 33 of the respective support plates are connected (e.g. by screwing) with vertical connecting rods 32 fixed to a vertical bar 31 located at the rear side of the frame 40. With this mechanical construction, a simultaneous movement of all support plates 3 can be achieved by moving the actuation bar 20 within the slot of the middle support plate. FIG. 7 shows a scenario in which the actuation bar 20 is not inserted into slot of the middle support plate. As a consequence, all locking devices on all support plates are in the locked position. When inserting the actuation bar into the slot of the middle plate, a movement of the vertical bar 31 is effected in a horizontal direction to the right due to the movement of the movable panel in the middle support plate. The movement of the vertical bar 31 results in a movement of the movable panels in the upper and lower support plates due to the connection of the connecting rods 32 with protruding pins 33. As a consequence, the position shown in FIG. 8 is reached where all locking devices on all support plates are in the unlocked position.

Figure 9:
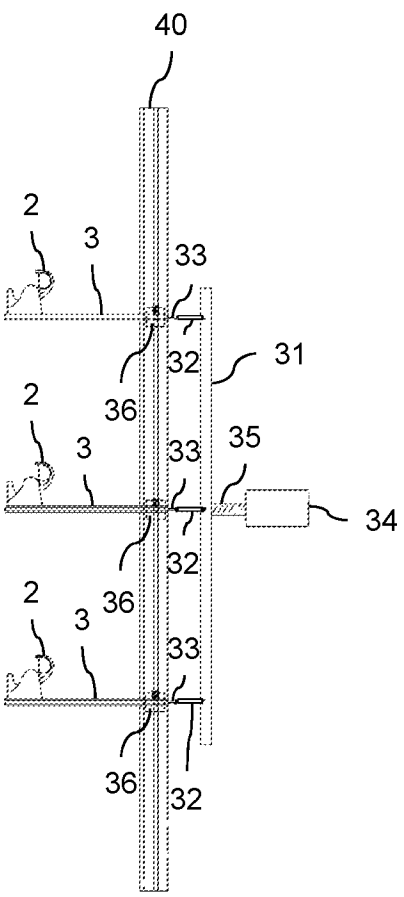
FIG. 9 is a side view of a modification of the embodiment of FIGS. 7 and 8 where an electromechanical actuator is used for locking and unlocking the locking devices.
Figure 8:
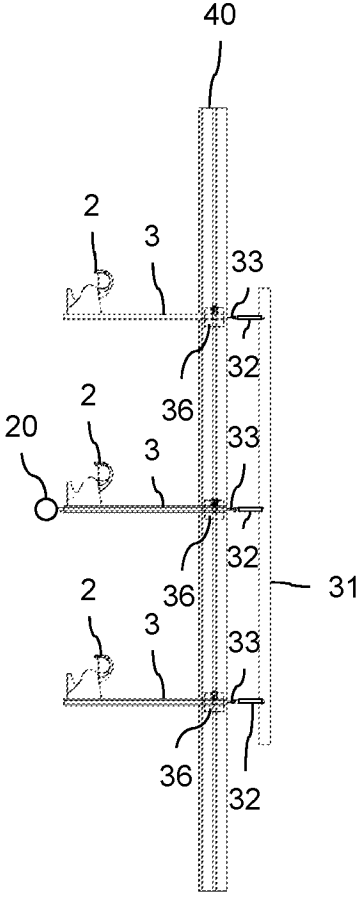
FIG. 8 is a side view of the apparatus of FIG. 7 with the locking devices in the unlocked position.

FIG. 9 shows a modification of the embodiment of FIGS. 7 and 8. The embodiment of FIG. 9 also comprises three vertically aligned support plates 3 disposed on the frame 40 by suitable attachment devices 36. Each support plate in FIG. 9 corresponds to the support plate shown in FIGS. 1 to 6 with the only difference that the actuation device 30 at the front edge of the plate is omitted and that a protruding pin 33 is provided at the rear edge of the movable panel. In other words, all support plates shown in FIG. 9 have the same structure as the upper and lower support plates shown in FIGS. 7 and 8. The embodiment of FIG. 9 also comprises a vertical connecting bar 31 with corresponding horizontal connecting rods 32 disposed thereon as it is the case in FIGS. 7 and 8. The connecting rods 32 are connected to the protruding pins 33, analogously to FIGS. 7 and 8. However, contrary to the embodiment shown in FIGS. 7 and 8, the movement of the vertical connecting rod 31 is not achieved manually by an actuation bar. Instead, an electromechanical actuator in the form of a motor 34 is located behind the connecting bar 31. This motor is connected via a spindle 35 with the connecting bar 31. The motor effects a movement of the spindle 35 resulting in a vertical movement of the connecting rod 31 so that a movement between the locked position and the unlocked position of the locking devices 2 on the support plates 3 can be achieved automatically by the motor 34. In FIG. 9, the unlocked position of the locking devices 2 is shown.

The embodiments as described in the foregoing have several advantageous. Particularly, in an apparatus for presenting items on one or more horizontal support plates, an opening and closing of locking devices on those support plates is achieved with a single operation, e.g. pushing or pulling an actuation bar, by manual actuation or via an electromechanical actuator. This locking and unlocking is implemented by an easy mechanical system using a movable member and particularly a movable panel between upper and lower panels of the respective support plates, where this mechanical system is not visible for users viewing the items presented by the apparatus. Moreover, due the integration of the movable panel within the horizontal support plate, this plate can also be disposed on existing horizontal surfaces used for exposing items.

LIST OF REFERENCE NUMERALS

1 apparatus for presenting items
2 locking device
3 support plate
3*a* front edge of the support plate
3*b*, 3*c* side edges of the support plate
3*d* rear edge of the support plate
301 upper panel
302 lower panel
303 middle panel
303*a* opening in the middle panel
4 pair of eyeglasses
401, 402 glasses
403 nose bridge
404, 405 temples
5 hook
6 housing
601, 602 housing parts
7, 7' replaceable reduction elements
8 opening
9 hole
10 movable panel
10*a* protrusion of the movable panel
10*b*, 10*c* openings in the movable panel
11 spacer
12 sliding element
13 vertical pins
14, 14' horizontal pins
15 horizontal cog portion
16 cog wheel
17 curved cog portion
18 horizontal shaft
19 U-shaped profile
20 actuation bar
20*a* gripping portion
20*b*, 20*b'*, 20*c* permanent magnets
21 slot
22*a*, 22*b*, 22*c*, 22*d* holes in the housing part
22*e*, 22*f* pockets in the housing part
23, 23' inserts
23*a*, 23*a'*, 23*b*, 23*b'* cylindrical holes in the inserts
24, 24' cut-out portions in the middle panel
24*a*, 24*a'*, 24*b*, 24*b'* semi-circular depressions
25*a*, 25*b* permanent magnets
26 recesses
27 slot
28 permanent magnet
29*a*, 29*b* screws
29*c* distance ring
30 actuation device
31 vertical connecting bar
32 horizontal connecting rods
33 protruding pins
34 electromechanical actuator
35 spindle
36 attachment devices
40 frame

The invention claimed is:

1. An apparatus for presenting items, particularly eyeglasses, comprising:

one or more support plates, each support plate configured to receive items side by side in a horizontal direction thereon when the apparatus is in use;

one or more locking devices arranged on a respective support plate, each locking device configured to be movable between a locked position for mechanically locking one of the items at the locking device and an unlocked position for releasing the one of the items from the locking device, wherein the respective support plate further comprises a movable member disposed between a first panel of the support plate being, an upper panel when the apparatus is in use and a second panel of the support plate being a lower panel when the apparatus is in use, where the movable member is configured to mechanically interact with an actuation portion and with the one or more locking devices such that the movable member can be moved by the actuation portion between a first position in which each locking device of the one or more locking devices is in the locked position and a second position in which each locking device of the one or more locking devices is in the unlocked position.

2. The apparatus according to claim 1, wherein the movable member is a movable panel.

3. The apparatus according to claim 1, wherein a middle panel is disposed between the first panel and the second panel, the middle panel having a shape such that a space is formed between the first panel and the second panel, the movable member being positioned in this space, wherein the middle panel extends at a front edge of the support plate facing toward a first side from which items placed on the support plate are viewed so that the movable member is not visible from the first side.

4. The apparatus according to claim 1, wherein the first panel and the second panel are spaced apart from each other by a distance greater than a thickness of the movable member.

5. The apparatus according to claim 1, wherein each of the plurality of locking devices comprises a movable element which is movable within a housing of the locking device and configured to effect a movement of a locking element in the locking device, where the movable element is connected to the movable member so that the movement of the movable member results in a movement of the movable element.

6. The apparatus according to claim 5, wherein the locking element is a hook that is rotatable between the locked position and the unlocked position, where in the locked position the hook forms at least a part of an enclosing portion that defines a hole in the locking device that is configured to accommodate at least one item, wherein the enclosing portion is opened when the hook is rotated from the locked to the unlocked position.

7. The apparatus according to claim 5, wherein the moving element is coupled to the locking element via a gear mechanism, wherein the gear mechanism comprises at least one cog wheel engaging with a first portion of cogs on the movable element and a second portion of cogs on the locking element.

8. The apparatus according to claim 6, further comprising at least one reduction element reducing a size of the hole by which the at least one item is fixed in the locked position.

9. The apparatus according to claim 1, wherein actuation portion is configured to effect a manual movement of the movable member.

10. The apparatus according to claim 1, wherein the actuation portion comprises an actuation device located between the first panel and the second panel, the actuation device further comprising one or more pins, wherein each pin is located in a corresponding recess in the movable member when each locking device is in the locked position, wherein the actuation portion further comprises a slot in the movable member for inserting an actuation bar into the slot, where the insertion of the actuation bar into the slot effects a retraction of each pin from the corresponding recess wherein the actuation bar is configured to push the movable member so that the movable member moves from the first position to the second position.

11. The apparatus according to claim 10, wherein the actuation device further comprises a number of first permanent magnets exerting a magnetic force which presses each pin in the corresponding recess when each locking device is in the locked position, wherein the actuation device is configured to interact with a number of second permanent magnets of the actuation bar exerting a magnetic force on each pin which retracts each pin from the corresponding recess when the actuation bar is inserted into the slot.

12. The apparatus according to claim 11, wherein the actuation device further comprises at least one third permanent magnet which is configured to interact with at least one fourth permanent magnet in the actuation bar so that the at least one third permanent magnet and the at least one fourth permanent magnet effect a coupling between the movable member and the actuation bar via an attractive force between the at least one third permanent magnet and the at least one fourth permanent magnet when the actuation bar inserted into the slot reaches a stop position within the slot, where the coupling enables a movement of the movable member from the second position to the first position by pulling the actuation bar out of the slot.

13. The apparatus according to claim 1, wherein the actuation portion is configured to effect an automatic movement of the movable member via at least one electromechanical actuator.

14. The apparatus according to claim 1, comprising several of the support plates arranged one above the other, where the actuation portion comprises a mechanical connection between the support plates such that the actuation portion effects a simultaneous movement of the movable members in each of the several support plates between the first position and the second position.

15. The apparatus according to claim 14, wherein the mechanical connection comprises a connecting bar having connecting rods for each of the several support plates, each connecting rod being mechanically connected to the movable member of the respective support plate of the several support plates in order to effect the movement of the movable member in the respective support plate of the several support plates.

* * * * *